United States Patent [19]

Campagna, Jr. et al.

[11] 4,067,659

[45] Jan. 10, 1978

[54] MANHOLE CLOSURE ASSEMBLY

[75] Inventors: Samuel A. Campagna, Jr., Deptford, N.J.; Benjamin J. Campagna, Newark, Del.

[73] Assignee: BES, Ltd., Wilmington, Del.

[21] Appl. No.: 740,977

[22] Filed: Nov. 11, 1976

[51] Int. Cl.[2] ..... E02D 29/14

[52] U.S. Cl. ..... 404/25; 404/4; 210/165

[58] Field of Search ..... 404/25, 26, 5, 4; 52/21; 210/165, 163

[56] References Cited

U.S. PATENT DOCUMENTS

| | | | |
|---|---|---|---|
| 606,554 | 6/1898 | Jacobs | 404/25 X |
| 1,066,316 | 7/1913 | Piper | 404/5 X |
| 2,095,024 | 10/1937 | Boosey | 210/165 X |
| 2,163,221 | 6/1939 | Slocum | 404/25 |
| 3,037,631 | 6/1962 | Drehmann | 210/165 |
| 3,712,009 | 1/1973 | Campagna | 404/25 X |
| 3,973,856 | 8/1976 | Gaglioti | 464/25 |

*Primary Examiner*—Nile C. Byers
*Attorney, Agent, or Firm*—Connolly and Hutz

[57] ABSTRACT

Manhole closure assembly for preventing storm water from entering into manhole opening comprises cover section including downwardly depressed central portion. Circular mounting flange extends outwardly from depressed central portion and flange is adapted to rest upon inwardly directed manhole cover supporting flange of annular manhole frame. Downwardly depressed portion of cover section is depressed amount that exceeds path of spin of manhole cover resting upon supporting flange of annular manhole frame. First valve member is secured to cover section to relieve pressure inside manhole when pressure therein exceeds predetermined amount.

10 Claims, 2 Drawing Figures

MANHOLE CLOSURE ASSEMBLY

BACKGROUND OF THE INVENTION

The present invention relates to a manhole closure assembly, and more particularly to a closure that prevents drainage and storm water from emptying into a manhole that leads to a sewerage system.

It is desirable to segregate sanitary or sewerage systems from those systems designed to handle storm and drainage water since such segregation reduces an unnecessary burden on the sewerage treatment facility. As is well known, when drainage and storm water empties into a sanitary system, the sewerage treatment plant must necessarily handle and treat the storm water in addition to the raw sewage. Standard frames and covers for manholes that lead to sanitary or sewerage systems generally include heavy cover constructions with passageways therein that serve to vent the overall system for the purpose of relieving internal pressure as well as vacuum buildups. The passageways in these manhole covers also enable storm water to infiltrate the sewerage system. It is impossible to simply seal off or otherwise eliminate the cover passageways since pressure developed within the system could easily produce a force sufficient to blow the cover away from its seated position at the manhole opening or blast the plugs away from the passageways. Additionally, pressure developed within the sewerage system could easily cause damage to the system if that pressure is not relieved.

With an oversized sewerage or sanitary system, storm water infiltrating the system does not prevent any major problems. On the other hand, with many existing systems capacity is already at peak level, and it is estimated that 40% of that capacity is the direct result of storm or drainage water. For the most part, storm water volume draining into sewerage systems is much more acute today than it was years back, and the key factor is that today there is significantly less pervious area than there was even several years ago. This factor is due to larger impervious street areas, larger parking lots, increased construction and smaller building lots, all of which cut down on the amount of overall pervious area heretofore available to absorb storm and drainage water. These factors have significantly attributed to the problem of overtaxing present sewerage systems. By significantly preventing storm and drainage water from entering into such systems, existing facilities can easily handle an additional 60% or more sewerage capacity.

Manhole closure assemblies are described in U.S. Pat. No. 3,798,848, granted Mar. 26, 1974, and U.S. Pat. No. 3,969,847, granted July 20, 1976. These closure assemblies require a separate support ring normally located directly below the cover supporting flange of an annular manhole frame. However, when the heavy manhole cover is manipulated for removal, it often spins or rolls into the manhole where the cover strikes the closure assembly causing damage and/or knocking it into the manhole. Also, installation of the assemblies described in these patents is a time consuming procedure.

U.S. Pat. No. 3,712,009, granted Jan. 23, 1973, also describes a manhole closure assembly comprising a plurality of parts. Installation of this assembly is time consuming and there is a real danger of parts falling into the manhole during the installing procedure. Since the closure assemblies of the above noted patents also include a plurality of parts, there is a real danager of the parts falling into the manhole during installation of these assemblies too.

SUMMARY OF THE INVENTION

Accordingly, an object of the present invention is to provide a manhole closure assembly that functions to effectively and easily seal off a manhole opening in an efficient and highly economical manner to thereby prevent drainage and storm water from emptying into the manhole while relieving pressure that may occur within the manhole.

Another object of the present invention is to provide a manhole closure assembly which is easy to install and substantially reduces the installation time of heretofore proposed assemblies.

Another object of the present invention is to provide a manhole closure assembly which is simple in design, easy and economical to manufacture, and which may be conveniently shipped in large quantities.

In accordance with the present invention a manhole closure assembly for preventing storm water from entering into a manhole opening comprises a cover section including a downwardly depressed central portion. The cover section further comprises an outwardly extending circular mounting flange adapted to rest upon the inwardly directed manhole cover supporting flange of an annular manhole frame. The downwardly depressed portion of the cover section is depressed an amount that exceeds the path of spin of a manhole cover resting upon the supporting flange of the annular manhole frame. Also, the assembly includes a first valve member secured to the cover section adapted to relieve pressure inside the manhole when the pressure therein exceeds a predetermined amount.

Preferably, the manhole closure assembly of the present invention includes a second valve member secured to the cover section adapted to relieve vacuum inside the manhole when the vacuum therein exceeds a predetermined amount. Also, the downwardly depressed central portion of the cover section may be dish shaped. It is preferred that the cover section be of unitary construction with a uniform thickness throughout.

Sealing material may be located on the upper and lower surfaces of the outwardly extending mounting flange of the cover section. Also, handle structure may be provided on the upper surface of the depressed central portion of the cover section for manipulating the closure assembly.

BRIEF DESCRIPTION OF THE DRAWING

Novel features and advantages of the present invention in addition to those mentioned above will become apparent to those skilled in the art from a reading of the detailed description in conjunction with the accompanying drawing wherein similar reference characters refer to similar parts and in which.

DETAILED DESCRIPTION OF THE INVENTION

Figure 1:
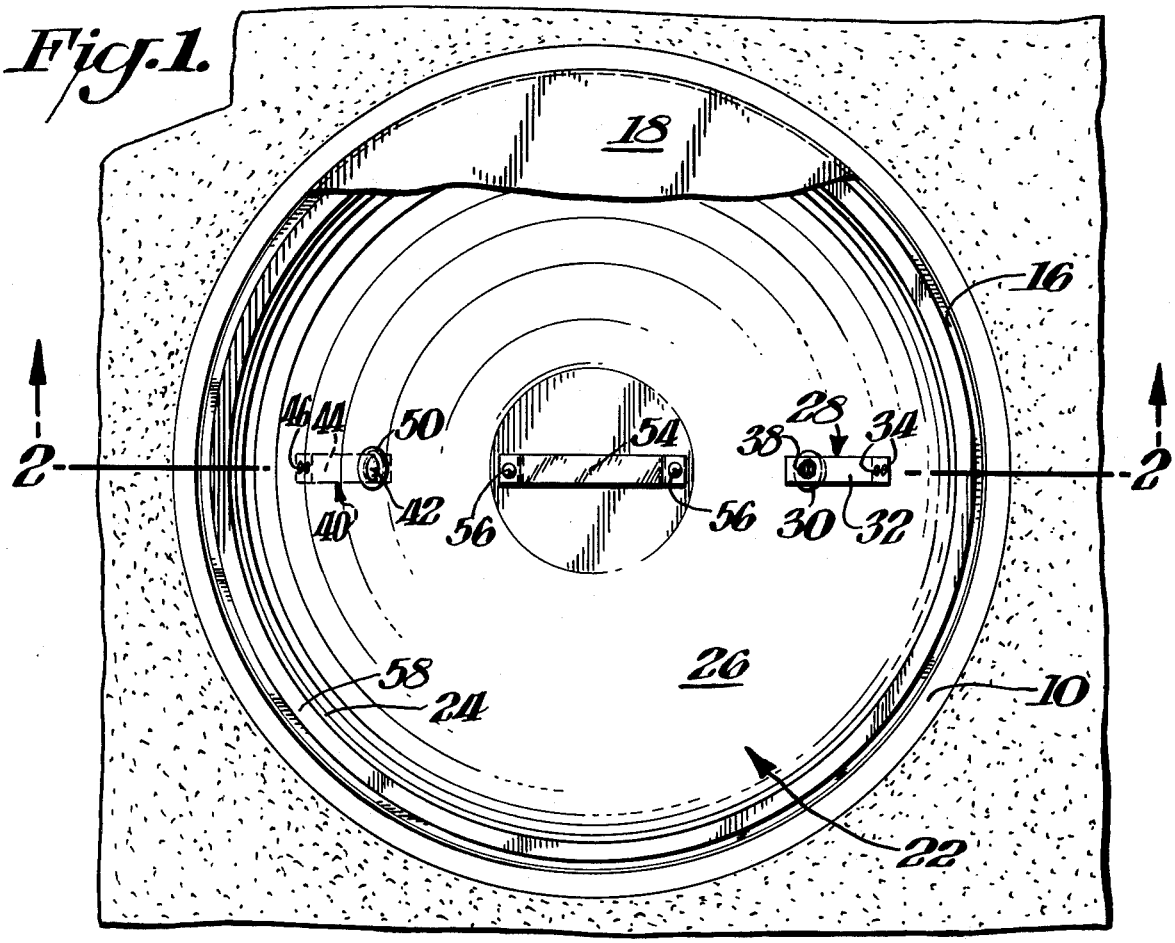
FIG. 1 is a top plan view of a manhole frame and cover with portions broken away to show a closure assembly located directly below the cover.
Figure 2:
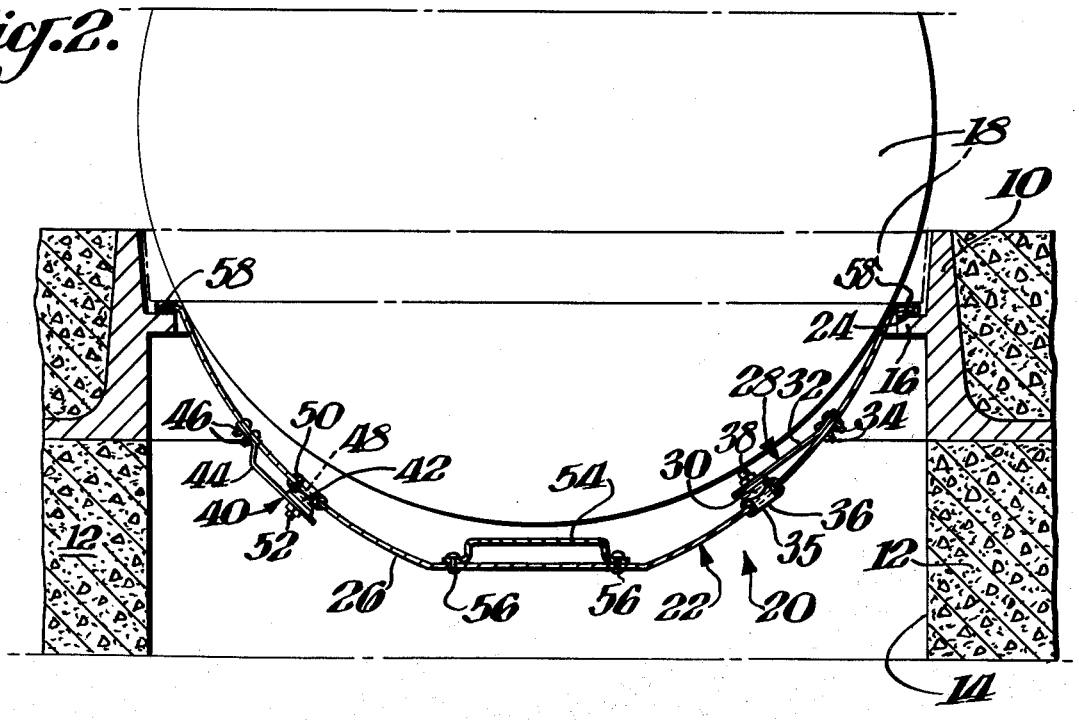
FIG. 2 is a sectional view taken alone line 2-2 of FIG. 1, illustrating the path of cover roll or spin in phantom outline.

Referring in more particularity to the drawing, FIGS. 1 and 2 illustrate an annular manhole frame 10 secured in place above a masonry manhole foundation 12. The frame and foundation form what is commonly called a manhole 14. The frame 10 is of common construction and is usually formed by casting techniques well known in the art. The frame includes an inwardly directed cover supporting flange 16 upon which rests a manhole cover 18 that closes off the manhole opening.

A manhole closure assembly 20 is located within the opening 14 for preventing storm and drainage water from entering into the opening. The closure assembly 20 comprises a cover section 22 fabricated from aluminum or similar material. Alternatively, the cover section may be made of thermoplastic material or stainless steel. Techniques known in the art may be used to form the cover section 22 into the desired shape such as spinning and stamping techniques when the construction material is one of the above metals. When thermoplastic material is selected from the construction of the cover section, the desired shape may be imparted to the material by blow moulding or pressure moulding, for example.

The cover section 22 includes an outwardly extending circular mounting flange 24 constructed and arranged to rest upon the cover supporting flange 16 of the manhole frame 10. Additionally, the cover section 22 further includes a downwardly depressed central portion 26 which is depressed an amount that exceeds the path of spin the manhole cover 18, as explained more fully below.

A pressure relief valve member 28 is secured to the cover section 22 on the upper surface thereof for relieving pressure inside the manhole 14 when the pressure exceeds a predetermined amount, such as five pounds per square inch above atmospheric conditions. The valve 28 comprises a valve element 30 fastened to the cover section 22 by a spring steel leaf 32. The leaf may be anchored to the cover section by suitable fasteners 34, as shown best in FIG. 2. The valve element 30 has a seated position where it seals off an opening 35 in the cover section. The opening is surrounded by a rubber grommet 36 pressed into the cover section, as shown in FIG. 2, and the valve element 30 normally rests against the grommet 36. The element 30 may be fabricated from any suitable material, such as neoprene, for example, and a suitable fastener 38 secures the neoprene valve element to the spring steel leaf 32.

A vacuum relief valve 40 is secured to the cover section 22 on the under-surface thereof for relieving the vacuum inside the manhole 14 when it exceeds a predetermined amount such as five pounds per square inch below atmospheric conditions. The vacuum relief valve 40 is fabricated of the same materials as the pressure relief valve 28. Vacuum valve 40 includes an element 42 secured to the cover section 22 by a spring steel leaf 44. Suitable fasteners 46 are utilized to anchor the spring steel leaf 44 to the cover section. An opening 48 in the cover section is surrounded by a rubber grommet 50 and the valve element 42 is normally seated against the grommet 50. The element 42 is secured to the spring steel leaf 44 by a suitable fastener 52.

The cover section 22 also includes a handle 54 mounted on the upper surface of the downwardly depressed central portion of the cover section by rivets 56 or any other convenient fastening structure. The handle 54 serves as a convenient means for manipulating the manhole closure assembly during the installation procedure.

Finally, sealing material 58 is provided on the upper and lower surfaces of the outwardly extending circular mounting flange 24 of the cover section 22. The sealing material functions to provide a tight seal of the manhole 14 when the closure assembly 20 is installed.

Installation of the manhole closure assembly 20 is easily and efficiently accomplished by simply removing the manhole cover 18 from its seated position upon the inwardly directed supporting flange 16 of the annular manhole frame 10. After the cover 18 is so removed, the closure assembly 20 is simply positioned in place so that the circular mounting flange 24 of the cover section 22 rests upon the supporting flange 16. The handle 54 is used to manipulate the closure assembly 20 into this position. The sealing material 58 between the lower surface of the flange 24 and the upper surface of the manhole frame flange 16 provides a fluid tight seal. When the closure assembly is in place as described above, the cover 18 is then replaced and the sealing material 58 on the upper surface of the mounting flange 24 is sandwiched between the cover 18 and flange 24. Rattling of the cover and the accompanying noise associated with such movement is eliminated by the sealing material 58.

With the closure assembly 20 installed as noted above, any significant pressure buildup within the manhole 14 is relieved by the pressure relief valve 28. For example, when the pressure inside the manhole exceeds five pounds per square inch above atmospheric conditions, the valve element 30 is forced away from its seated position and the excessive pressure is relieved via the opening 35. Similarly, when excessive vacuum exists within the manhole 14, the vacuum relief valve 40 functions to relieve the excessive vacuum. For example, when the vacuum in the manhole exceeds five pounds per square inch below atmospheric conditions, that vacuum pulls the element 42 away from its seated position covering opening 48. The excessive vacuum is then relieved via the opening 48 until it is reduced to a tolerable level.

As shown best in FIG. 2, the cover section 22 of the closure assembly includes a downwardly depressed central portion 26 depressed by an amount that exceeds the path of spin of the manhole cover 18. The central portion 26 is substantially dish shaped and is so dimensioned that the cover 18 does not strike the closure assembly even when the cover is rolled into a vertical position, as shown in FIG. 2. As is well known, when manhole covers are removed, it is common that the cover be rolled into a vertical position where the cover edge rests upon the supporting flange 16 of the manhole frame. With a manhole closure in place, it is highly desirable that the closure be located so that such roll or spin of the cover 18 does not cause damage to the closure assembly.

Figure 3:
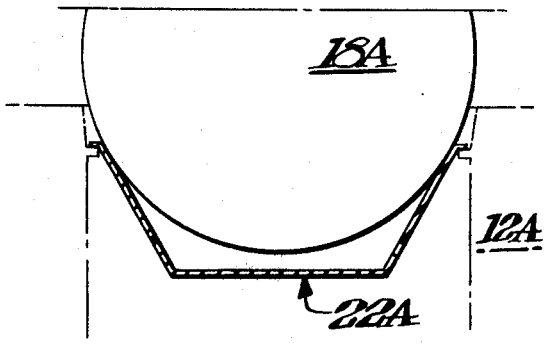
FIG. 3 is a sectional view illustrating an alternate embodiment of the cover section.
Figure 4:
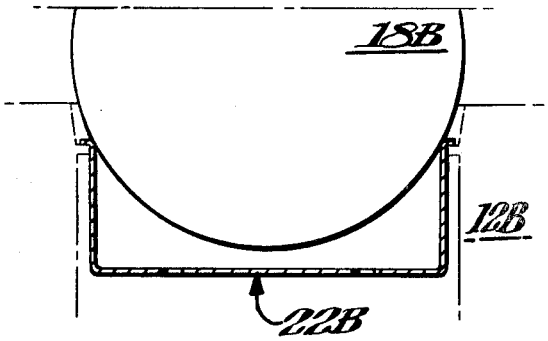
FIG. 4 is a sectional view illustrating still another embodiment of the cover section.

FIGS. 3 and 4 show alternate embodiments of the cover section 22 of the assembly 20. Specifically, FIG. 3 illustrates a downwardly depressed frusto-conical cover section **22*a* while FIG. 4 shows a downwardly depressed cylindrical cover section 22*b*. In each instance the cover section is depressed by an amount that exceeds the path of the spin of the manhole cover. In the case of the embodiment illustrated in FIG. 3, cover 18*a* may be rolled into a vertical position without striking the cover section 22***a* and the same is true of the cover 18*b*. With the exception of the shape of the cover sections 22*a* and 22*b*, each closure assembly is substantially identical to the closure assembly 20 of FIGS. 1 and 2. The pressure and vacuum valves, sealing material and handle means have been eliminated for convenience and clarity.

What is claimed:

1. A manhole closure assembly for preventing storm water from entering into a manhole opening in combination with an annular manhole frame and a manhole cover therefor, the closure assembly comprising a cover section including an outwardly extending circular mounting flange constructed and arranged to rest upon an inwardly directed manhole cover supporting flange of the annular manhole frame, the manhole cover normally resting upon the cover supporting flange of the annular manhole frame but having a path of spin into the manhole opening during manipulation of the cover, the cover section further including a downwardly depressed central portion extending into the manhole opening an amount that exceeds the path of spin of the manhole cover resting upon the supporting flange of the annular manhole frame whereby the depressed central portion is spaced from the path of cover spin at all locations along the surface thereof, and a first valve member secured to the cover section constructed and arranged to relieve pressure inside the manhole when the pressure therein exceeds a predetermined amount.

2. A manhole closure assembly as in claim 1 including a second valve member secured to the cover section constructed and arranged to relieve vacuum inside a manhole when the vacuum therein exceeds a predetermined amount.

3. A manhole closure assembly as in claim 1 wherein the downwardly depressed central portion of the cover section is substantially dish shaped.

4. A manhole closure assembly as in claim 1 wherein the cover section is of unitary construction having a substantially uniform thickness throughout.

5. A manhole closure assembly as in claim 1 including sealing material on the upper and lower surfaces of the outwardly extending circular mounting flange of the cover section.

6. A manhole closure assembly as in claim 1 including handle means on the upper surface of the downwardly depressed central portion of the cover section.

7. A manhole closure assembly as in claim 1 wherein the cover section is of unitary construction having a substantially uniform thickness throughout, the cover section being substantially dish shaped with handle means on the upper surface of the depressed central portion thereof.

8. A manhole closure assembly as in claim 7 including a second valve member secured to the cover section constructed and arranged to relieve vacuum inside a manhole when the vacuum therein exceeds a predetermined amount.

9. A manhole closure assembly as in claim 1 wherein the downwardly depressed central portion of the cover section is substantially frusto-conical.

10. A manhole closure assembly as in claim 1 wherein the downwardly depressed central portion of the cover section is substantially cylindrical.

* * * * *